US008944169B2

(12) United States Patent
Campbell

(10) Patent No.: US 8,944,169 B2
(45) Date of Patent: Feb. 3, 2015

(54) APPARATUS AND METHOD FOR FRACTURING A WELL

(71) Applicant: Stonecreek Technologies Inc., Luxembourg (LU)

(72) Inventor: Sean Patrick Campbell, Airdire (CA)

(73) Assignee: Stonecreek Technologies Inc., Luxembourg (LU)

( * ) Notice: Subject to any disclaimer, the term of this patent is extended or adjusted under 35 U.S.C. 154(b) by 0 days.

(21) Appl. No.: 13/775,404

(22) Filed: Feb. 25, 2013

(65) Prior Publication Data

US 2013/0161015 A1 Jun. 27, 2013

Related U.S. Application Data

(63) Continuation of application No. PCT/CA2011/000944, filed on Aug. 23, 2011.

(60) Provisional application No. 61/376,364, filed on Aug. 24, 2010.

(51) Int. Cl.

| | |
|---|---|
| ***E21B 43/26*** | (2006.01) |
| ***E21B 34/14*** | (2006.01) |
| ***E21B 21/10*** | (2006.01) |

(Continued)

(52) U.S. Cl.

CPC ..... *E21B 43/26* (2013.01); *E21B 21/103* (2013.01); *E21B 23/00* (2013.01); *E21B 34/102* (2013.01); *E21B 34/103* (2013.01); *E21B 34/14* (2013.01); *E21B 2034/007* (2013.01)

USPC ..... 166/308.1; 166/318

(58) Field of Classification Search

USPC ..... 166/373, 381, 383, 386, 318, 332.1, 166/332.4, 387, 260, 152, 188, 202, 308.1, 166/177.5

See application file for complete search history.

(56) References Cited

U.S. PATENT DOCUMENTS 3,209,834 A 10/1965 Essary
3,554,281 A * 1/1971 Ecuer ..... 166/155

(Continued)

FOREIGN PATENT DOCUMENTS

CA 2142113 12/1994
CA 2682621 4/2010

(Continued)

OTHER PUBLICATIONS

International Search Report, International Application No. PCT/CA2011/000944 International Filing date Aug. 23, 2011, mailing date Nov. 14, 2011 (4pp.).

*Primary Examiner* — Daniel P Stephenson
(74) *Attorney, Agent, or Firm* — Stephen M. De Klerk

(57) ABSTRACT

Apparatus and methods are provided for fracturing a well in a hydrocarbon bearing formation. The apparatus can include one or more valve sub-assemblies assembled into a tubing string inserted into an unlined well. The valve sub-assembly can include a sliding piston initially pinned in place to seal off ports that provide communication between the interior of the tubing string and a production zone of the formation. A ball can be inserted into a tubing string and moved along the tubing string by injected pressurized fracturing fluid until the ball sits on a valve seat of a valve sub-assembly coupled to the sliding piston to close off the tubing string below the valve. The force of the fluid forces the piston downwards to shear off the pins and open the ports. Fracturing fluid can then exit the ports to fracture the production zone of the formation.

19 Claims, 9 Drawing Sheets

(51) Int. Cl.

| | |
|---|---|
| ***E21B 23/00*** | (2006.01) |
| ***E21B 34/10*** | (2006.01) |
| *E21B 34/00* | (2006.01) |

(56) References Cited

U.S. PATENT DOCUMENTS

| | | | | |
|---|---|---|---|---|
| 5,020,600 | A * | 6/1991 | Coronado | 166/387 |
| 7,500,526 | B2 * | 3/2009 | Telfer | 166/387 |
| 7,703,510 | B2 * | 4/2010 | Xu | 166/177.5 |
| 7,814,981 | B2 | 10/2010 | Marcu | |
| 7,954,555 | B2 * | 6/2011 | Ashy et al. | 166/386 |
| 2002/0074128 | A1 * | 6/2002 | Allamon et al. | 166/373 |
| 2003/0127227 | A1 | 7/2003 | Fehr et al. | |
| 2006/0124310 | A1 | 6/2006 | Lopez de Cardenas et al. | |
| 2007/0272411 | A1 * | 11/2007 | Lopez de Cardenas et al. | 166/305.1 |
| 2010/0263873 | A1 * | 10/2010 | Turner et al. | 166/308.1 |
| 2011/0036590 | A1 | 2/2011 | Williamson et al. | |
| 2011/0240295 | A1 | 10/2011 | Porter et al. | |
| 2011/0240301 | A1 | 10/2011 | Robison et al. | |
| 2011/0278017 | A1 * | 11/2011 | Themig et al. | 166/373 |
| 2012/0193098 | A1 | 8/2012 | Turner et al. | |
| 2013/0161015 | A1 * | 6/2013 | Campbell | 166/308.1 |

FOREIGN PATENT DOCUMENTS

| | | |
|---|---|---|
| CA | 2693813 | 6/2011 |
| WO | WO 2010/124371 | 4/2010 |

* cited by examiner

APPARATUS AND METHOD FOR FRACTURING A WELL

CROSS-REFERENCE TO RELATED APPLICATIONS

This is a continuation of International Application No. PCT/CA2011/000944 filed on Aug. 23, 2011 which claims priority of U.S. Provisional Patent Application No. 61/376,364 filed Aug. 24, 2010 and hereby incorporates the same provisional application by reference herein in its entirety.

TECHNICAL FIELD

The present disclosure is related to the field of apparatuses and methods for fracturing a well in a hydrocarbon bearing formation, in particular, down-hole valve subassemblies that can be opened to fracture production zones in a well.

BACKGROUND

It is known to use valve subassemblies placed down into a well using tubing, such as an uncased horizontal well that can be opened to fracture an oil producing formation to increase the flow of oil from the formation. These valve subassemblies or "subs" can comprise a ball valve seat mechanism that can receive a ball, which is placed into the tubing and travels down the tubing until it reaches the ball valve seat mechanism. Once the ball is seated in the valve seat, flow through the valve sub is cut off. The pressure of fracturing fluid injected into the tubing will cause the closed valve seat mechanism to slide a piston forward in the valve sub thereby opening ports in the wall of the valve sub to allow the pressure of the fracturing fluid penetrate into a production zone of a hydrocarbon bearing formation. The ball valve seat mechanism can be comprised of varying sized openings. Typically, a number of the valve subs are placed in series in the tubing at predetermined intervals in spacing along the well into the formation. The largest diameter valve seat is placed nearest the top of the well with progressively smaller diameter valve seats with each successive valve sub placed further along the tubing string.

In this manner, the furthest valve sub, the one having the smallest diameter opening can be closed by placing the matching sized ball into the tubing, which can pass through all of the preceding valve subs, each having larger diameters than the valve sub being closed, until the ball reaches its matching valve sub. One shortcoming of these known ball valve seat mechanisms is that the volume of fluid, and the rate of fluid flow, is constricted by the progressively decreasing diameter of the ball valve seat mechanism disposed in each of the valve subs, which becomes increasingly restricted with each successive valve sub in the tubing string. While the number of these valve subs can be as high as 23 stages, put in place with a packer system, the flow-rate that can be obtained through these valve subs is not high.

Another shortcoming of these known ball valve seat mechanisms is that the ball seats constrict the well bore with their presence. As such, full production and the ability to run conventional tools for production, work-overs and isolation testing are not possible. Current systems have balls and seats left in the well bore restricting production and plugging off sections of the liner with sand and balls. It is known to drill out balls and seats to achieve full production and access, however, the bore is still not full drift and is left with a restricted diameters inhibiting conventional tool use. In addition, these drill-outs are very costly and time consuming.

It is, therefore, desirable to provide a fracturing valve sub that overcomes the shortcomings of the prior art.

SUMMARY

An apparatus for fracturing a well in a formation is provided. The apparatus includes a tubular valve body with an upper end and a lower end, and a valve passageway extending therethrough, the valve body further including at least one valve port extending through a sidewall thereof, the at least one valve port located nearer the upper end; a tubular piston valve slidably disposed in the valve passageway and configured to provide communication therethrough, the piston valve configured to move from a raised position where the at least one valve port is closed to a lowered position where the at least one valve port is open; a ball seat sub-assembly slidably disposed in the valve passageway between the piston valve and the lower end, the ball seat sub-assembly including a ball seat passageway extending therethrough; and an inner piston sub-assembly releasably coupled to the piston valve and configured to disengage from the piston valve when pulled away from the ball seat. The ball seat sub-assembly is configured to move the piston valve from the raised position to the lowered position when downward force is applied to the ball seat sub-assembly.

In some embodiments, the apparatus further includes means for holding the piston valve in the lowered position when it is moved from the raised position.

In some embodiments, the apparatus further includes means for holding the piston valve in the lowered position when it is moved from the raised position and the holding means includes a ratchet ring disposed on the piston valve and corresponding ratchet threads disposed on an end-subassembly, wherein the end-subassembly is disposed at the lower end of the valve body.

In some embodiments, the apparatus further includes means for holding the piston valve in the lowered position when it is moved from the raised position and the holding means includes fingers disposed on the piston valve and a corresponding groove disposed on an end-subassembly, wherein the end-subassembly is disposed at the lower end of the valve body.

In some embodiments, the ball seat sub-assembly further includes a bypass port extending therethrough for allowing fluid circulation through the ball seat sub-assembly.

In some embodiments, the ball seat sub-assembly further includes a bypass port extending therethrough for allowing fluid circulation through the ball seat sub-assembly, the inner piston sub-assembly is releasably coupled to the ball seat sub-assembly, and the inner piston sub-assembly is configured to pull away from the ball seat sub-assembly to open the bypass port.

In some embodiments, the apparatus includes a removal tool configured to separate the ball seat sub-assembly and the inner piston sub-assembly from the valve body.

In some embodiments, the apparatus includes a removal tool configured to separate the ball seat sub-assembly and the inner piston sub-assembly from the valve body, and the removal tool includes a tubular upper body with an upper removal tool end configured for coupling to coil tubing and a tubular lower body configured for coupling to the inner piston sub-assembly, the lower body coupled to a lower end of the upper body, wherein the upper body and lower body define a passageway extending through the removal tool.

A method for fracturing a well in a formation is provided. The method includes the steps of providing an apparatus including a tubular valve body with an upper end and a lower end, and a valve passageway extending therethrough, the valve body further including at least one valve port extending through a sidewall thereof, the at least one valve port located nearer the upper end; a tubular piston valve slidably disposed in the valve passageway and configured to provide communication therethrough, the piston valve configured to move from a raised position where the at least one valve port is closed to a lowered position where the at least one valve port is open; a ball seat sub-assembly slidably disposed in the valve passageway between the piston valve and the lower end, the ball seat sub-assembly including a ball seat passageway extending therethrough; and an inner piston sub-assembly releasably coupled to the piston valve and configured to disengage from the piston valve when pulled away from the ball seat. The ball seat sub-assembly is configured to move the piston valve from the raised position to the lowered position when a downward force is applied to the ball seat sub-assembly. The method further includes placing the apparatus in a tubing string disposed in the well, the apparatus located near a production zone in the formation; placing a ball configured to seal off the ball seat passageway when seated on the ball seat sub-assembly into the tubing string; and injecting pressurized fracturing fluid into the tubing string wherein the fracturing fluid moves the ball through the tubing string into the apparatus until the ball is seated on the ball seat sub-assembly and places the downward force on the ball seat sub-assembly to move the piston valve from the closed position to the open position, wherein the fracturing fluid can pass through the at least one valve port of the apparatus to fracture the formation.

In some embodiments, the piston valve is held in the lowered position when it is moved from the raised position.

In some embodiments, the piston valve is held in the lowered position when it is moved from the raised position by a ratchet ring disposed on the piston valve and corresponding ratchet threads disposed on an end-subassembly, wherein the end-subassembly is disposed at the lower end of the valve body.

In some embodiments, the piston valve is held in the lowered position when it is moved from the raised position by fingers disposed on the piston valve and a corresponding groove disposed on an end-subassembly, wherein the end-subassembly is disposed at the lower end of the valve body.

In some embodiments, the ball seat sub-assembly includes a bypass port extending therethrough for allowing fluid circulation through the ball seat sub-assembly.

In some embodiments, the inner piston sub-assembly is releasably coupled to the ball seat sub-assembly, and the inner piston sub-assembly is configured to pull away from the ball seat sub-assembly to open the bypass port.

In some embodiments, the method further includes providing a removal tool configured to separate the ball seat sub-assembly and the inner piston sub-assembly from the valve body; and separating the ball seat sub-assembly and the inner piston sub-assembly from the valve body with the removal tool.

In some embodiments, the method includes providing a removal tool configured to separate the ball seat sub-assembly and the inner piston sub-assembly from the valve body; and separating the ball seat sub-assembly and the inner piston sub-assembly from the valve body with the removal tool. The removal tool includes a tubular upper body with an upper removal tool end configured for coupling to coil tubing and a tubular lower body configured for coupling to the inner piston sub-assembly, the lower body coupled to the lower end of the upper body, wherein the upper body and lower body define a passageway extending through the removal tool.

In some embodiments, the method further includes providing a removal tool configured to separate the ball seat sub-assembly and the inner piston sub-assembly from the valve body; separating the ball seat sub-assembly and the inner piston sub-assembly from the valve body with the removal tool; providing a shifting tool; and shifting the piston back to the raised position with the shifting tool.

A system for use downhole in a well is provided. The system includes at least one apparatus, the apparatus including a tubular valve body with an upper end and a lower end, and a valve passageway extending therethrough, the valve body further including at least one valve port extending through a sidewall thereof, the at least one valve port located nearer the upper end; a tubular piston valve slidably disposed in the valve passageway and configured to provide communication therethrough, the piston valve configured to move from a raised position where the at least one valve port is closed to a lowered position where the at least one valve port is open; a ball seat sub-assembly slidably disposed in the valve passageway between the piston valve and the lower end, the ball seat sub-assembly including a ball seat passageway extending therethrough; and an inner piston sub-assembly releasably coupled to the piston valve and configured to disengage from the piston valve when pulled away from the ball seat. The ball seat sub-assembly is configured to move the piston valve from the raised position to the lowered position when downward force is applied to the ball seat sub-assembly. The system further includes at least one ball configured to seal off the ball seat passageway when seated on the ball seat sub-assembly wherein the at least one ball is configured to specifically engage the ball seat sub-assembly of a particular apparatus and the at least one ball is targeted to the particular apparatus.

In some embodiments, the at least one apparatus further includes means for holding the piston valve in the lowered position when it is moved from the raised position.

In some embodiments, the at least one apparatus further includes a ratchet ring disposed on the piston valve and corresponding ratchet threads disposed on an end-subassembly, wherein the end-subassembly is disposed at the lower end of the valve body.

In some embodiments, the at least one apparatus further includes fingers disposed on the piston valve and a corresponding groove disposed on an end-subassembly, wherein the end-subassembly is disposed at the lower end of the valve body.

In some embodiments, the ball seat sub-assembly further includes a bypass port extending therethrough for allowing fluid circulation through the ball seat sub-assembly.

In some embodiments, the ball seat sub-assembly further includes a bypass port extending therethrough for allowing fluid circulation through the ball seat sub-assembly, the inner piston sub-assembly is releasably coupled to the ball seat sub-assembly, and the inner piston sub-assembly is configured to pull away from the ball seat sub-assembly to open the bypass port.

In some embodiments, the system further includes a removal tool configured to separate the ball seat sub-assembly and the inner piston sub-assembly from the valve body.

In some embodiments, the system further includes a removal tool configured to separate the ball seat sub-assembly and the inner piston sub-assembly from the valve body, and the removal tool includes a tubular upper body with an upper removal tool end configured for coupling to coil tubing and a tubular lower body configured for coupling to the inner piston sub-assembly, the lower body coupled to the lower end of the upper body, wherein the upper body and lower body define a passageway extending through the removal tool.

DETAILED DESCRIPTION OF EMBODIMENTS

Figure 1:
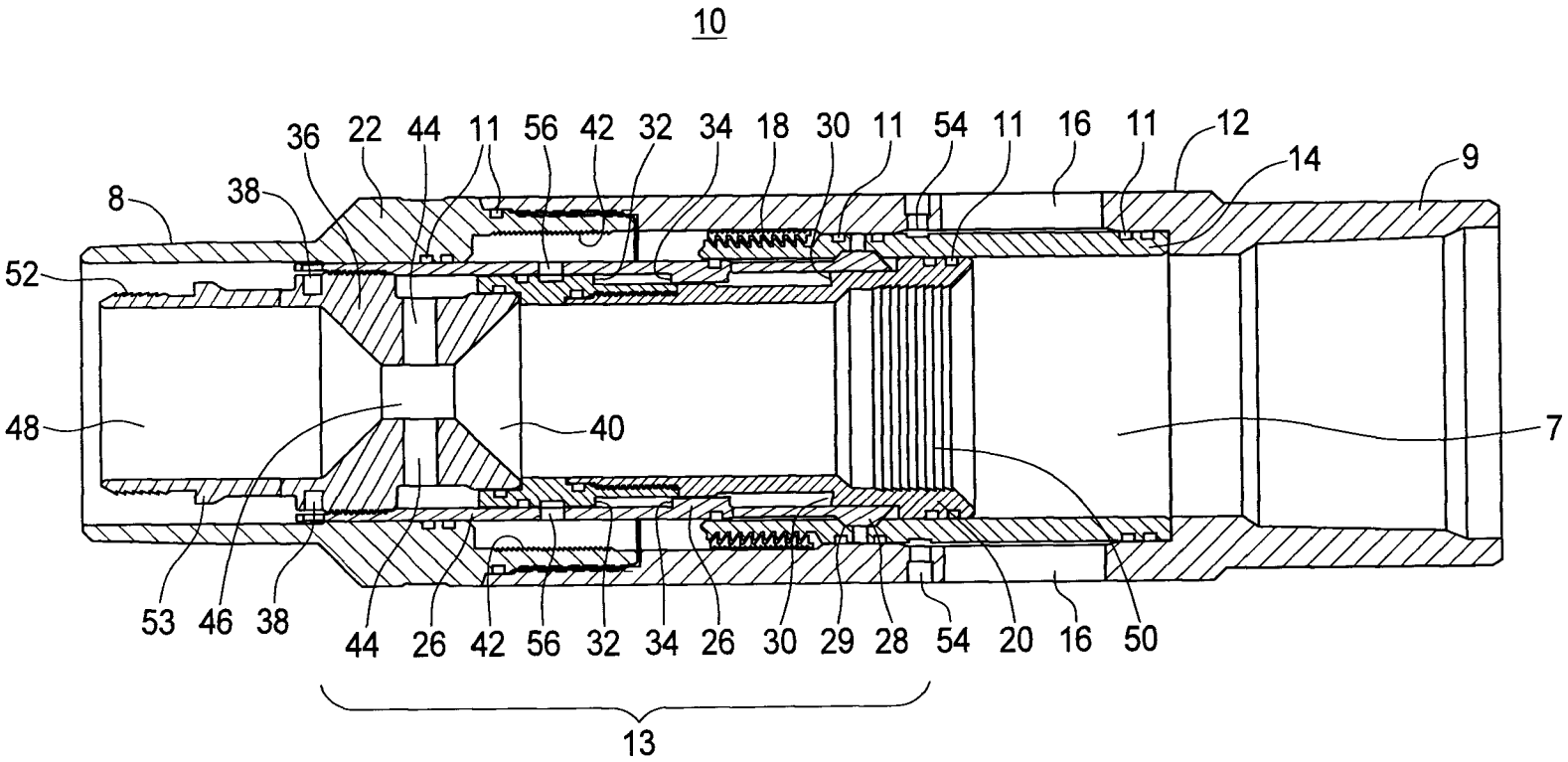
FIG. 1 is a cross-section elevation view depicting a first embodiment of a frac valve with the valve closed.
Figure 2:
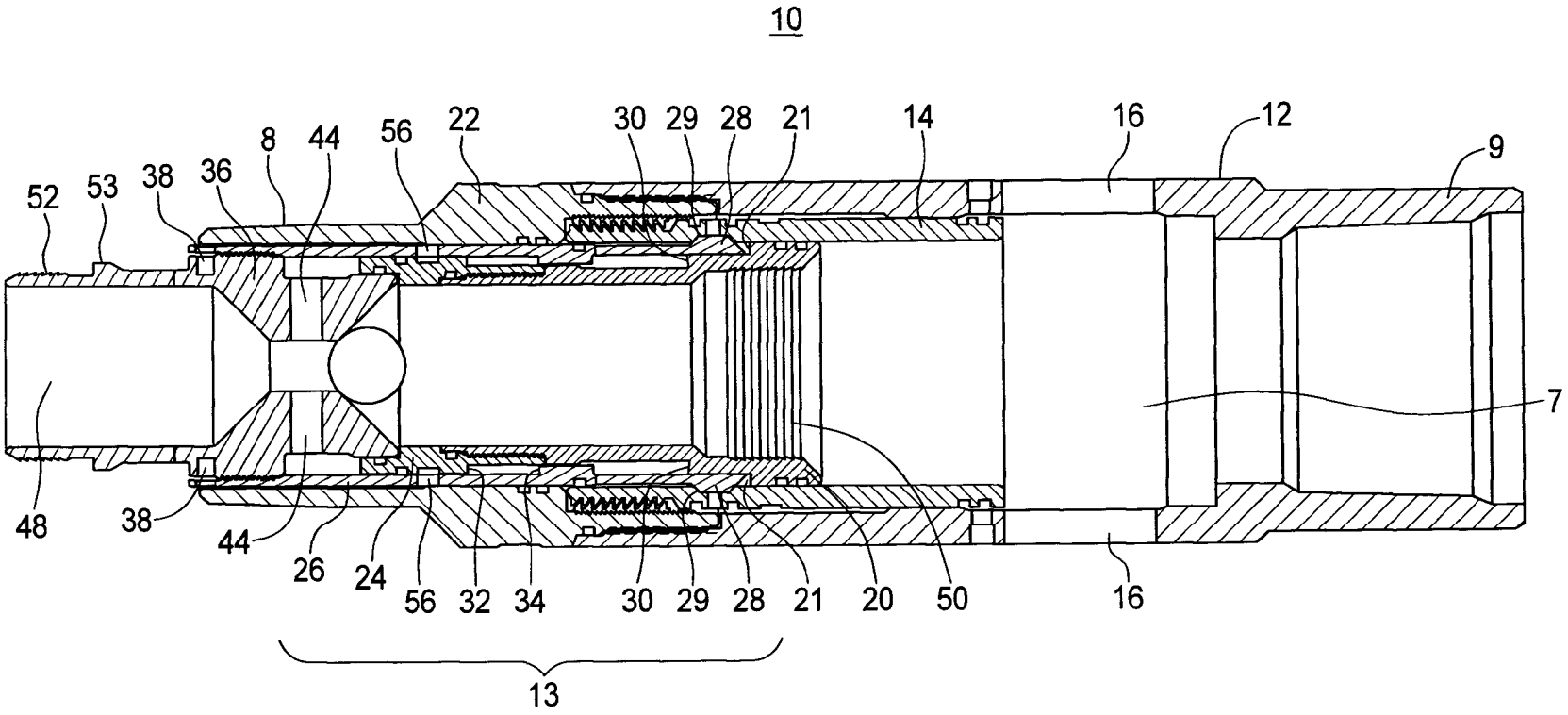
FIG. 2 is a cross-section elevation view depicting the frac valve of FIG. 1 with the valve open.

FIGS. 1 and 2 illustrate an embodiment of fracturing valve subassembly ("sub") 10. Referring to FIG. 1, the major components of valve sub 10 can comprise tubular valve body 12 having box end 9, tubular end sub-assembly 22 having pin end 8 disposed on a lower end of body 12 and tubular piston 14 slidably disposed within body 12, defining passageway 7 extending through from box end 9 to pin end 8. When assembled, piston 14 can be held in a raised or closed position within body 12 by shear screws 54 to close off valve ports 16 that provide communication through the sidewall of body 12. In some embodiments, piston 14 can further comprise ratchet ring 18 disposed on a lower end thereof. Ratchet ring 18 can be configured to engage ratchet threads 42 disposed on an interior surface of end subassembly 22 and hold piston 14 in a lower position to keep ports 16 open when piston 14 is moved from the raised or closed position to the lowered or open position.

In some embodiments, valve sub 10 can further comprise ball seat sub-assembly 36 slidably disposed within body 12. Ball seat sub 36 can comprise ball seat 40 disposed at an upper end thereof, latching threads 52 disposed at a lower end thereof and passageway 46 providing communication therebetween. In further embodiments, ball seat sub 36 can further comprise ports 44 to provide communication between passageway 46 to the exterior of ball seat sub 36. In some embodiments, valve sub 10 can further comprise inner piston sub-assembly 13 (as more clearly shown in FIG. 9) that can operatively couple ball seat sub 36 to piston 14. Inner piston sub 13 can further comprise latching sleeve 26, lower inner piston 24 and upper inner piston 20. In some embodiments, the lower end of latching sleeve 26 can be coupled to ball seat sub 36 with set screws 38. The upper end of latching sleeve 26 can comprise latching fingers 28 configured to engage groove 30 disposed on the inner surface of piston 14. When unassembled, latching fingers 26 can be biased to move inwards towards each other. When assembled in valve sub 10, latching fingers 26 can be pushed outwards by upper inner piston 20 to engage groove 30 of piston 14 to operatively couple inner piston sub 13 to piston 14. In some embodiments, lower inner piston 24 can threadably couple to upper inner piston 20. Lower inner piston 24 can couple to latching sleeve 26 with shear screws 56. Lower inner piston 24 can be further configured to slidably engage the upper end of ball seat sub 36. In some embodiments, lower inner piston 24 can butted out against ball seat sub 36. Such positioning can allow for the use of a high formation breakdown pressure, for example, up to 15,000 psi, because lower inner piston 24 will not move from hydraulic downward force as it is already against ball seat sub 36.

Disposed throughout valve sub 10 are o-rings 11 to provide sealing means, as well known to those skilled in the art, between components that are assembled together and components that move with respect to one another.

When valve sub 10 is assembled to be placed in a tubing string, piston 14 can be positioned in the raised position to close valve ports 16, and ball seat sub 36 and inner piston assembly 13, which are operatively coupled to piston 14, can be in a retracted position in passageway 7 disposed nearer pin end 8.

Figure 3:
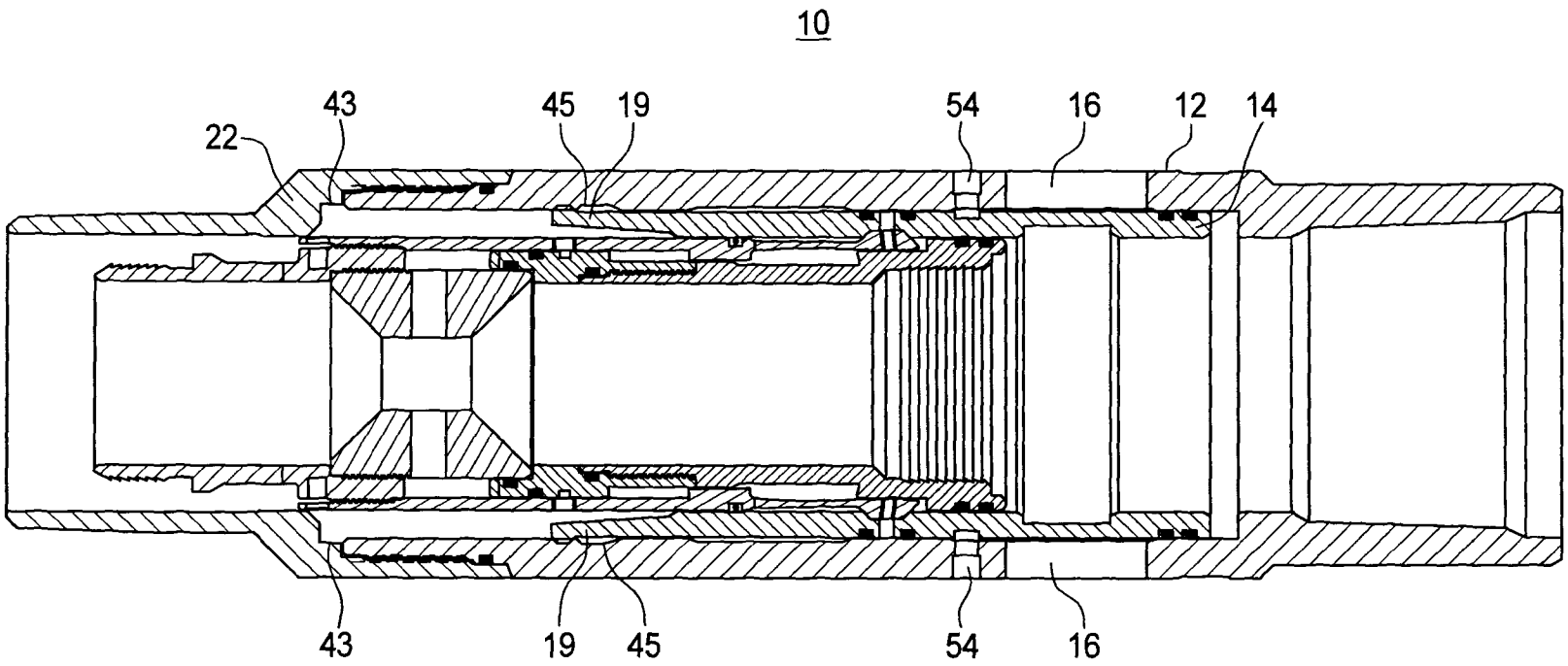
FIG. 3 is a cross-section elevation view depicting a second embodiment of a frac valve with the valve closed.
Figure 4:
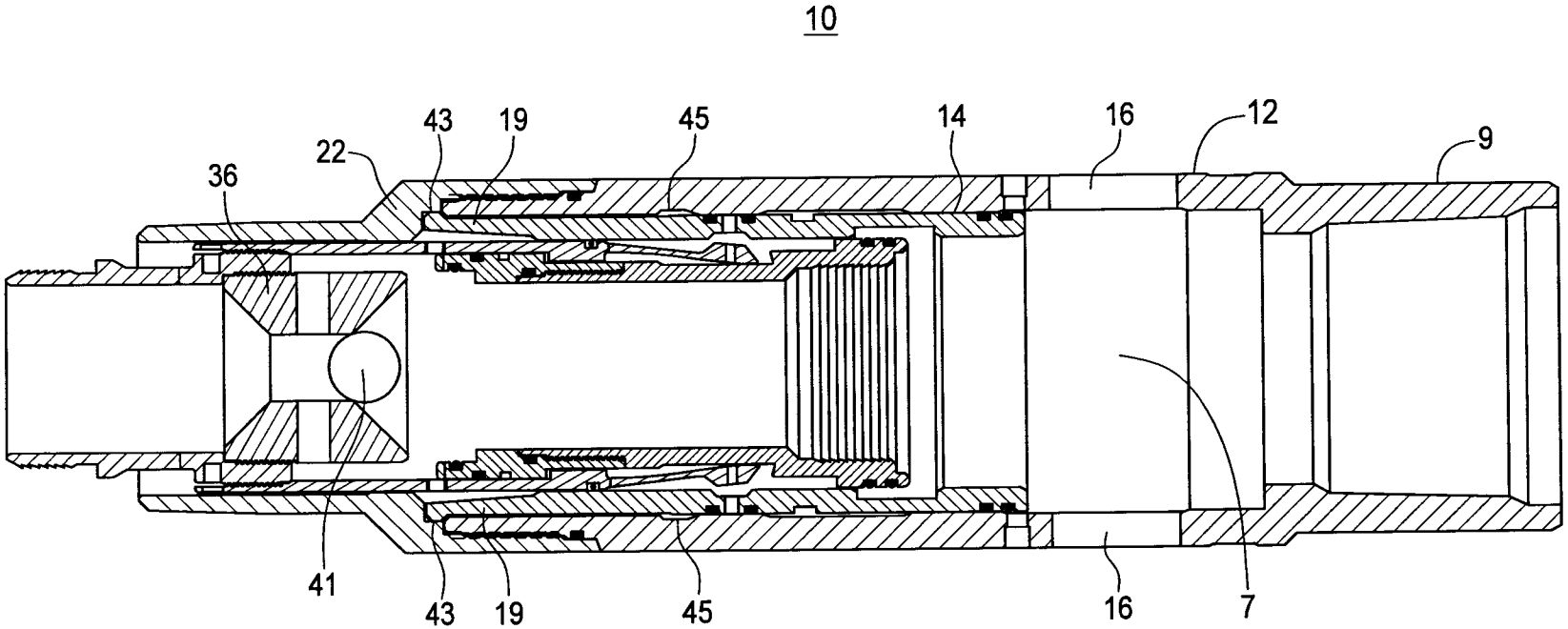
FIG. 4 is a cross-section elevation view depicting the frac valve of FIG. 3 with the valve open.

Referring to FIGS. 3 and 4, in some embodiments, piston 14 can further comprise piston fingers 19 disposed on a lower end thereof. Piston fingers 19 can be configured to engage valve body groove 43 disposed on an interior surface of end sub-assembly 22 and hold piston 14 in a lower position to keep ports 16 open when piston 14 is moved from the raised or closed position to the lowered or open position. Piston fingers 19 can be biased to move outwards away from each other. Referring to FIG. 3, when in the raised or closed position, piston fingers 19 can be held inwards by valve body 12. Referring to FIG. 4, when in the lowered or open position, piston fingers 19 can engage valve body groove 43.

Referring to FIGS. 2 and 4, valve sub 10 is shown with ball 41 seated on ball seat 40. When ball 41 is placed in the tubing string connected to box end 9 of valve sub 10, it can move along the tubing string by pressurized fracturing fluid injected into the tubing string. Ball 41 can flow down the tubing string until it reaches valve sub 10 and enters into passageway 7. Once in passageway 7, ball 41 can seat on ball seat 40 thereby closing off passageway 46. The pressurized fracturing fluid can then force ball seat sub 36 downwards. When the force of the fracturing fluid exceeds the shear force required to shear shear screws 54, piston 14 can be drawn downwards to a lowered or open position to open ports 16. In the lower position, ratchet ring 18 disposed on piston 14 can engage ratchet threads 42 to keep piston 14 in the lower position. In some embodiments, piston fingers 19 disposed on piston 14 can engage valve body groove 43 to keep piston 14 in the lower position. In order for ball 41 to seal off ball seat sub 36, the diameter of ball 41 must be greater than the diameter of passageway 46.

Figure 5:
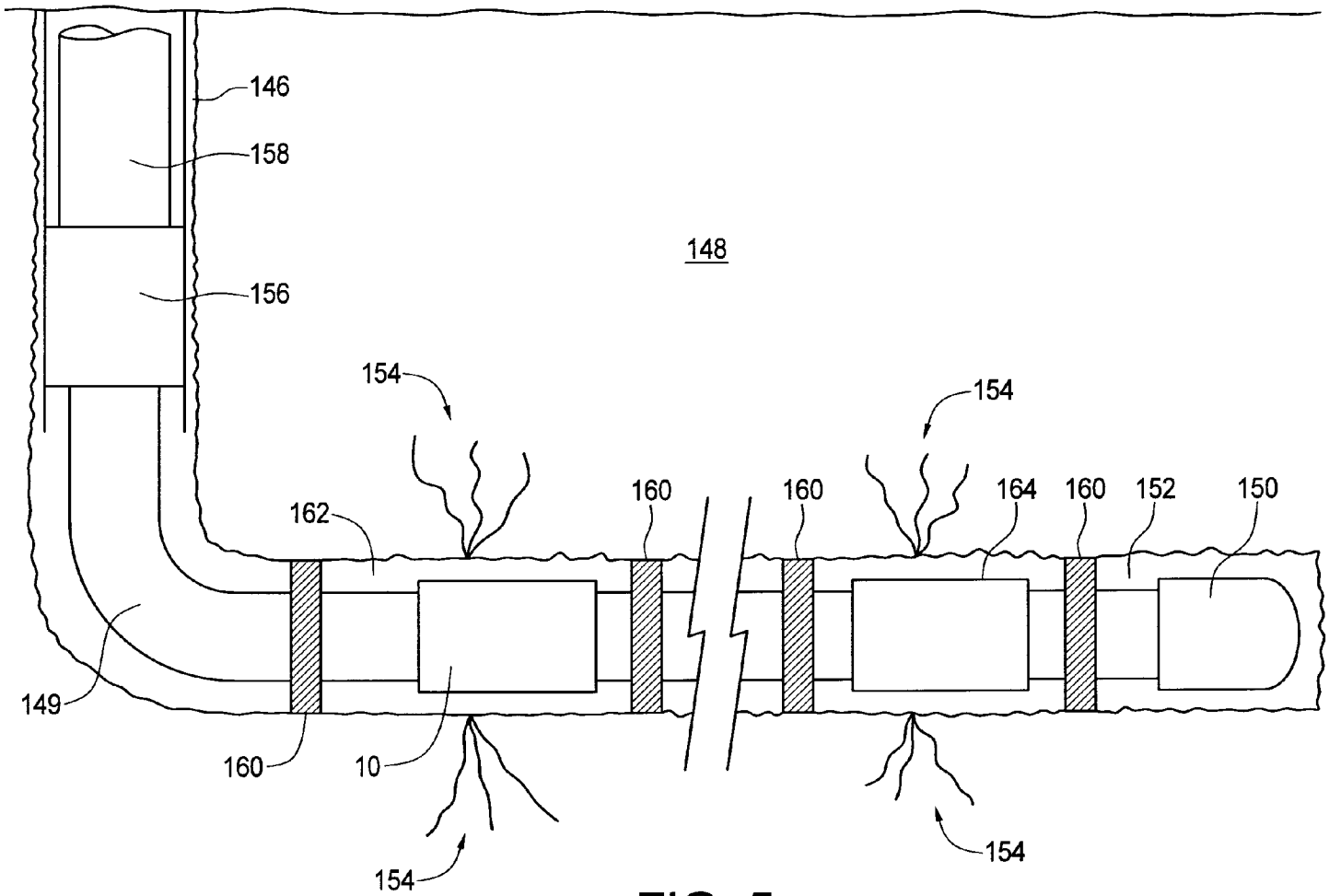
FIG. 5 is a side cross-sectional view depicting a well in a formation with a plurality of the valve subassemblies of FIG. 1.

Referring to FIG. 5, a cross-sectional view of a horizontal well comprising the apparatus described herein is shown. In this example, well 146 in formation 148 comprises tubing string 149 further comprising a plurality of valve subs 10 disposed along well 146. In installing tubing string 149, float shoe 150 can be run into well 146 through casing 158 and liner packer 156 into open hole horizontal well 152. Float shoe 150 can comprise a float collar, as well known to those skilled in the art, followed by a section of tubing 149, then followed by a valve sub 10. This can then be followed by another section of tubing 149 and another valve sub 10, and so on. A number of valve subs 10 can be placed in a single tubing string 149. This can be accomplished by each valve sub 10 having ball seat subs 36 with an increasingly larger diameter for passageway 46. For example, the valve sub 10 furthest along tubing string 149, or the one closest to float shoe 150, will have the narrowest diameter passageway 46. Each successive valve sub 10 from float shoe 150 would then have a diameter for passageway 46 larger than the valve sub 10 after it. Furthermore, the diameters of passageway 46 can be selected to allow the balls 41 for the valve subs 10 located further down to pass through until ball 41 reaches the valve sub 10 it is configured to seal off and open ports 16 thereof. In some embodiments, the diameter of passageway 46 can range from 0.830 inches to 2.430 inches, increasing in 0.100 inch increments. The diameter of ball 41 can, correspondingly, range from 0.900 inches to 2.500 inches, increasing in 0.100 inch increments. This arrangement can, therefore, provide up to 17 distinct or unique combinations of valve subs 10 and balls 41. The number of valve subs 10 and the spacing between the valve subs to be determined by the size of formation 148 and the number of production zones 154 contained in formation 148.

In some embodiments, tubing string 149 can further comprise open hole packers 160 disposed on tubing string 149 before and after each valve sub 10 to isolate the production zones 154 from one another. In other embodiments, packers 160 can comprise dual elements.

To stimulate the production of formation 148, ball 41 for the last valve sub 10 disposed in tubing string 149 can be inserted in the string followed by pressurized fracturing injected into tubing string 149. Ball 41 passes through all valve subs 10 until it reaches the last valve sub 10 to close off passageway 46 in ball seat sub 36.

The hydraulic force of the pressurized fracturing fluid applies a downward force on ball seat sub 36 and piston 14 until the force exceeds the shear force rating of shear screws 54 thereby allowing piston 14 slide downwards from a closed position, where ports 16 are sealed off, to an open position where ports 16 are opened. As piston 14 moves to the open position, ratchet ring 18 can engage ratchet threads 42 to lock piston 14 in place and to prevent piston 14 from sliding upwards to the closed position. In some embodiments, piston fingers 19 can engage valve body groove 43 to lock piston 14 in place and to prevent piston 14 from sliding upwards to the closed position.

After ball 41 has been placed, pressurized frac fluid can flow through ports 16 to hydraulically fracture production zone 164. After production zone 164 has been fractured, ball 41 for the next valve sub 10 along tubing string 149 can be inserted in the tubing string so that the next valve sub 10 can be opened, and the next production zone 154 can be fractured. This process can be then be repeated for each successive valve sub 10 along tubing string 149 until production zone 162 has been fractured.

Once the fracturing program for well 146 has been completed, the inner piston sub-assembly 13 in each valve sub 10 can be removed. Referring to FIGS. 6 to 9, one embodiment of inner piston removal tool 60 is shown. In some embodiments, removal tool 60 can comprise tubular upper body 62 and tubular lower body 64 disposed on the lower end of upper body 62 at junction 65, defining a passageway from inlet 84 to outlet 88. Lower body 64 can further comprise latch threads 68 configured to engage latching threads 50 disposed on upper inner piston 20. In some embodiments, removal tool 60 can further comprise latching sleeve 70 disposed in upper body 62 as means to couple upper body 62 to lower body 64. Latching sleeve 70 can be held in place inside upper body 62 by shear screws 76. Lower body 64 can further comprise of plurality of latching fingers 78, each have a head 80 at a distal end thereof. Latching fingers 78 can be further configured such that each 80 is biased inwardly towards each other. When removal tool 60 is assembled to couple upper body 62 to lower body 64, latch sleeve 70 can urge latching fingers 78 outwardly such that heads 80 fit into groove 82 to positively couple upper body 62 to lower body 64. Upper body 62 can further comprise box end 66 for coupling to coil tubing, which can be inserted into the tubing string (by coil tubing, which is not shown in the figure) to advance removal tool 60 from the surface to the first valve sub 10.

Figure 7:
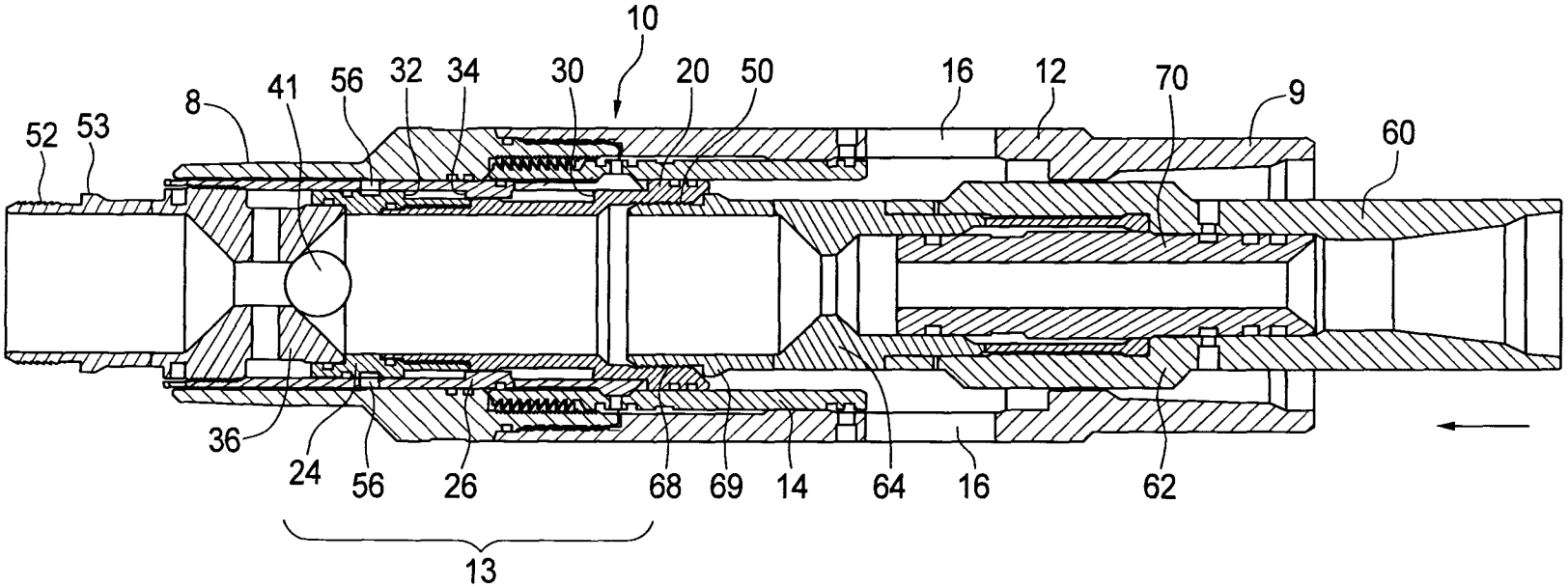
FIG. 7 is a cross-section elevation view depicting the frac valve of FIG. 1 with the removal tool of FIG. 5 inserted therein to attach to a inner piston sub-assembly.
Figure 8:
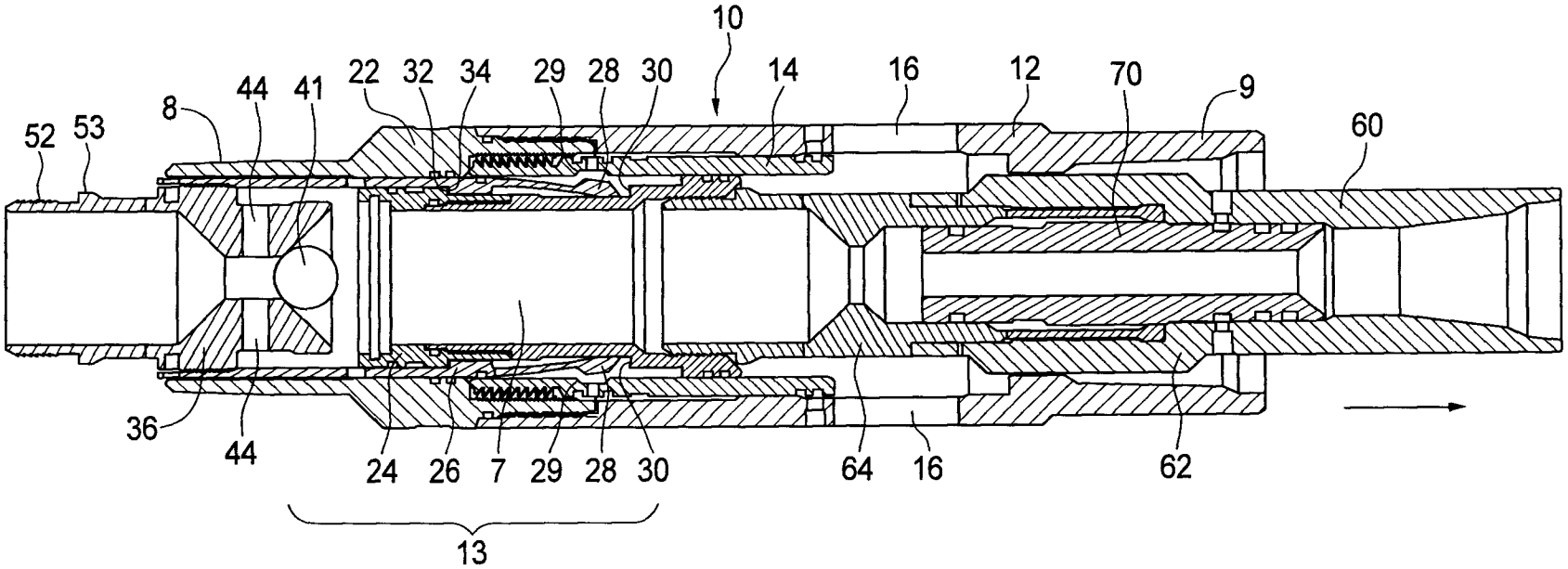
FIG. 8 is a cross-section elevation view depicting the frac valve of FIG. 6 with the removal tool of FIG. 5 raising the inner piston subassembly.

Referring to FIG. 7, removal tool 60 is shown being inserted into valve sub 10 wherein latching threads 68 can engage latching threads 50 of upper inner piston 20 until shoulder 69 contacts upper inner piston 20. Once removal tool 60 engages upper inner piston 20, the coil tubing (not shown) can be raised to lift removal tool 60 within valve sub 10, as shown in FIG. 8. In some embodiments, with sufficient force, for example 1000 lbs, raising removal tool 60 will cause shear screws 56 to shear allowing both upper inner piston 20 and lower inner piston 24 to lift away from ball seat sub 36 until shoulder 32 on lower inner piston 24 contacts shoulder 34 of latching sleeve 26. When this happens, upper inner piston 20 can rise relative to piston 14, which can allow latching finger 28 to disengage from groove 29 and couple with catch 30 disposed on upper inner piston 20. In addition, lower inner piston 24 can rise from ball seat sub 36 to now allow communication between ports 44 and passageway 7 and equalize the pressure of frac fluid above and below ball 41. In other words, if lower inner piston 24 is pulled away from ball seat sub 36, a bypass is opened through the ball seat allowing for fluid circulation either in forward or reverse. Once latching fingers 28 have pulled in from piston 14 and engage catch 30, ball seat sub 36 and inner piston sub 13 can move unrestricted in passageway 7.

Figure 9:
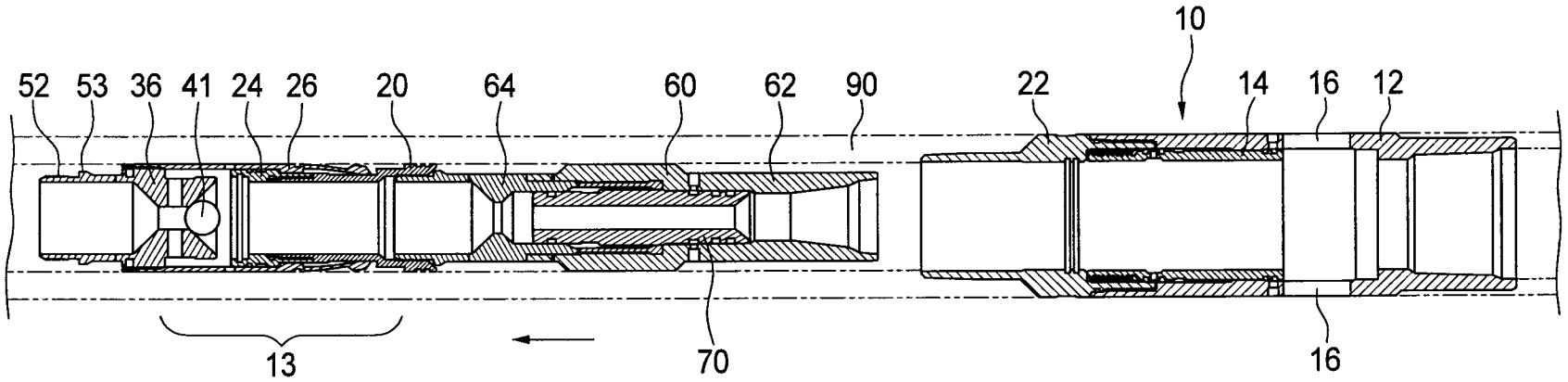
FIG. 9 is a cross-section elevation view depicting the frac valve of FIG. 7 with the removal tool pushing the inner piston sub-assembly towards another frac valve.

The coil tubing can then be lowered further, wherein removal tool 60 and inner piston sub 13 can be pushed further down tubing string 90 (as shown in FIG. 9) until the next valve sub 10 is encountered. Threads 52 and shoulder 53 of ball seat sub 36 can be configured to engage threads 50 on upper inner piston 20 of the next valve sub, wherein the procedure to disengage inner piston sub 13 from piston 14 can be repeated for the next valve sub 10. This procedure can then be repeated for each subsequent valve sub 10 until all of the inner piston subs 13 of all the valve subs 10 are stacked together and attached to removal tool 60. Once all the inner piston subs 13 have been removed from the valve subs 10, the coil tubing can be raised to bring all of the inner piston subs 13 to the surface.

Some embodiments can be configured as a pull release to overcome difficulties of releasing in a horizontal section of well 146. As would be understood by one skilled in the art, it can be easier to pull than push tubing string 90, as coupled tubing or coil can lose weight in a horizontal section of well 146. In addition, a pull release feature can eliminate the use of expensive fishing tools such as hydraulic accelerators, drill collars, hydraulic jars, and hydraulic bumper subs as would be known to one skilled in the art. In some embodiments, the pull release can allow for inner piston subs 13 to be removed from valve subs 10 with a low shear force, for example 500 lbs, with coil tubing.

When all inner piston subs 13 have been removed, the inside diameter of each valve sub 10 can be substantially the same, which can allow for a higher flow rate of substances from the well through tubing string 90. In addition, when all inner piston subs 13, balls 41 and ball seats 40 have been removed, the inside diameter of each valve sub 10 can be full-drift and allow for regular tools to run in the well bore for isolation testing or work-overs.

Figure 6:
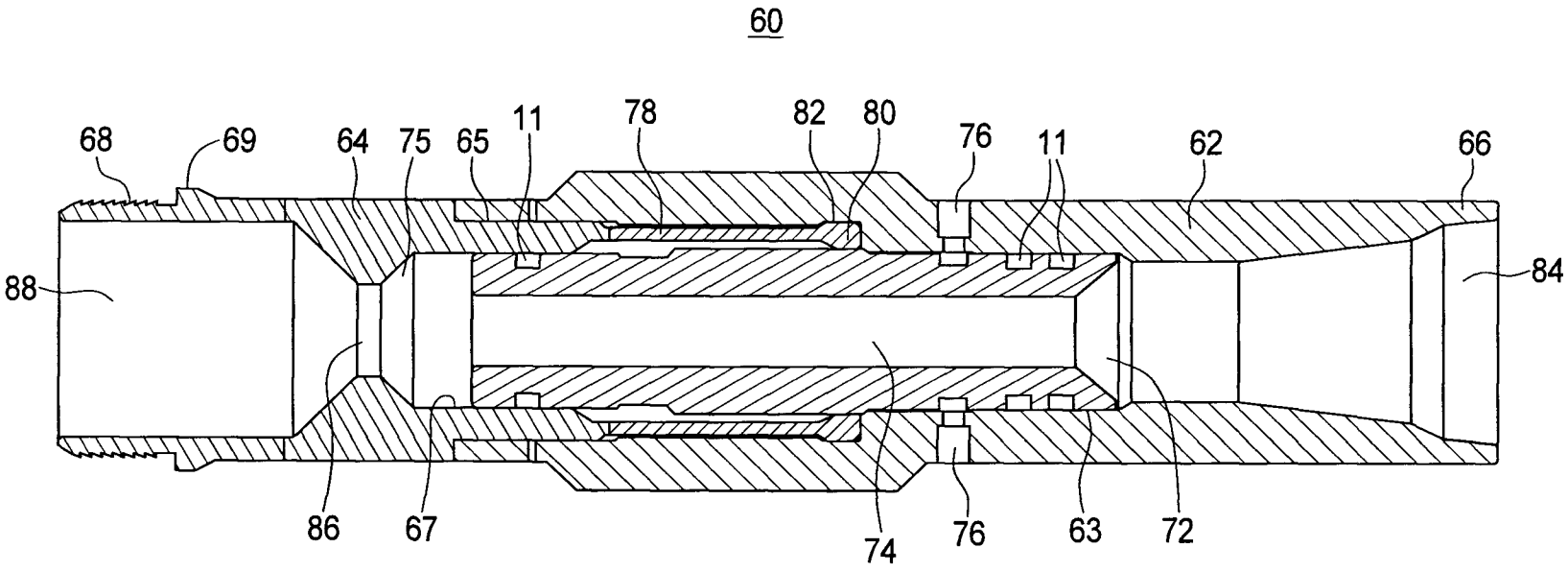
FIG. 6 is a cross-section elevation view depicting a removal tool for the frac valve of FIG. 1.

In the event that removal tool 60 or any of the removed inner piston subs 13 become stuck in the tubing string, upper body 62 of removal tool 60 can be separated from lower body 64 by inserting a ball (not shown) into the coil tubing until it seats on ball seat 74 to close off passageway 74 (as shown in FIG. 6) and injecting pressurized fluid into the coil tubing to exert downward force on latching sleeve 70 until screws 76 shear wherein latching sleeve 70 can slide downwardly in passageways 63 and 67 and allow heads 80 of latching fingers 78 to disengage groove 82, whereupon upper body 62 can be pulled away from lower body 64. Conventional removal tools, as well known to those skilled in the art, can then be inserted in the tubing string to remove the remainder of removal tool 60 and removed inner piston subs 13.

Following the removal of removal tool 60, ball seat 40, and inner piston sub 13, an operator can then shift valves 10 to a closed position and well 146 can be ready for production. Fracture valve sub 10 can be allowed to shift closed with a conventional shifting tool, as well known to those skilled in the art, after removal tool 60, ball seat 40, and inner piston sub 13 have been removed. The shifting tool can allow for a locking of the piston 14 in a closed position in the absence of shear pins 54. In some embodiments, piston fingers 19 can engage profile gap 45 on interior of valve body 12 in order to relock shifted piston 14 into a closed position, so that valve 10 may be reused.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

I claim:

1. An apparatus for fracturing a well in a formation, comprising:

(a) a tubular valve body comprising an upper end and a lower end, and a valve passageway extending therethrough, the valve body further comprising at least one valve port extending through a sidewall thereof, the at least one valve port located nearer the upper end;

(b) a tubular piston valve slidably disposed in the valve passageway and configured to provide communication therethrough, the piston valve configured to move from a raised position where the at least one valve port is closed to a lowered position where the at least one valve port is open;

(c) a ball seat sub-assembly slidably disposed in the valve passageway between the piston valve and the lower end, the ball seat sub-assembly comprising a ball seat passageway extending therethrough, the ball seat sub-assembly further comprising a bypass port extending therethrough for allowing fluid circulation through the ball seat sub-assembly; and (d) an inner piston sub-assembly releasably coupled to the piston valve and configured to disengage from the piston valve when pulled away from the ball seat, wherein the inner piston sub-assembly is releasably coupled to the ball seat sub-assembly, and the inner piston sub-assembly is configured to pull away from the ball seat sub-assembly to open the bypass port;

wherein the ball seat sub-assembly is configured to move the piston valve from the raised position to the lowered position when downward force is applied to the ball seat sub-assembly.

2. The apparatus of claim 1, further comprising means for holding the piston valve in the lowered position when it is moved from the raised position.

3. The apparatus of claim 2, wherein the holding means comprises a ratchet ring disposed on the piston valve and corresponding ratchet threads disposed on an end-subassembly, wherein the end-subassembly is disposed at the lower end of the valve body.

4. The apparatus of claim 2, wherein the holding means comprises fingers disposed on the piston valve and a corresponding groove disposed on an end-subassembly, wherein the end-subassembly is disposed at the lower end of the valve body.

5. The apparatus of claim 1, further comprising a removal tool configured to separate the ball seat sub-assembly and the inner piston sub-assembly from the valve body.

6. The apparatus of claim 5, wherein the removal tool comprises a tubular upper body comprising an upper removal tool end configured for coupling to coil tubing and a tubular lower body configured for coupling to the inner piston sub-assembly, the lower body coupled to the lower end of the upper body, wherein the upper body and lower body define a passageway extending through the removal tool.

7. A method for fracturing a well in a formation, the method comprising the steps of:

(a) providing an apparatus, comprising:

(i) a tubular valve body comprising an upper end and a lower end, and a valve passageway extending therethrough, the valve body further comprising at least one valve port extending through a sidewall thereof, the at least one valve port located nearer the upper end;

(ii) a tubular piston valve slidably disposed in the valve passageway and configured to provide communication therethrough, the piston valve configured to move from a raised position where the at least one valve port is closed to a lowered position where the at least one valve port is open;

(iii) a ball seat sub-assembly slidably disposed in the valve passageway between the piston valve and the lower end, the ball seat sub-assembly comprising a ball seat passageway extending therethrough, the ball seat sub-assembly further comprising a bypass port extending therethrough for allowing fluid circulation through the ball seat sub-assembly; and (iv) an inner piston sub-assembly releasably coupled to the piston valve and configured to disengage from the piston valve when pulled away from the ball seat, wherein the inner piston sub-assembly is releasably coupled to the ball seat sub-assembly, and the inner piston sub-assembly is configured to pull away from the ball seat sub-assembly to open the bypass port;

wherein the ball seat sub-assembly is configured to move the piston valve from the raised position to the lowered position when a downward force is applied to the ball seat sub-assembly;

(b) placing the apparatus in a tubing string disposed in the well, the apparatus located near a production zone in the formation;

(c) placing a ball configured to seal off the ball seat passageway when seated on the ball seat sub-assembly into the tubing string; and (d) injecting pressurized fracturing fluid into the tubing string wherein the fracturing fluid moves the ball through the tubing string into the apparatus until the ball is seated on the ball seat sub-assembly and places the downward force on the ball seat sub-assembly to move the piston valve from the closed position to the open position, wherein the fracturing fluid can pass through the at least one valve port of the apparatus to fracture the formation.

8. The method of claim 7, wherein the piston valve is held in the lowered position when it is moved from the raised position.

9. The method of claim 8, wherein the piston valve is held in the lowered position by a ratchet ring disposed on the piston valve and corresponding ratchet threads disposed on an end-subassembly, wherein the end-subassembly is disposed at the lower end of the valve body.

10. The method of claim 8, wherein the piston valve is held in the lowered position by fingers disposed on the piston valve and a corresponding groove disposed on an end-subassembly, wherein the end-subassembly is disposed at the lower end of the valve body.

11. The method of claim 7 further comprising:

(a) providing a removal tool configured to separate the ball seat sub-assembly and the inner piston sub-assembly from the valve body; and (b) separating the ball seat sub-assembly and the inner piston sub-assembly from the valve body with the removal tool.

12. The method of claim 11 wherein the removal tool comprises a tubular upper body comprising an upper removal tool end configured for coupling to coil tubing and a tubular lower body configured for coupling to the inner piston sub-assembly, the lower body coupled to the lower end of the upper body, wherein the upper body and lower body define a passageway extending through the removal tool.

13. A method for fracturing a well in a formation, the method comprising the steps of:

(a) providing an apparatus, comprising:

(i) a tubular valve body comprising an upper end and a lower end, and a valve passageway extending therethrough, the valve body further comprising at least one valve port extending through a sidewall thereof, the at least one valve port located nearer the upper end;

(ii) a tubular piston valve slidably disposed in the valve passageway and configured to provide communication therethrough, the piston valve configured to move from a raised position where the at least one valve port is closed to a lowered position where the at least one valve port is open;

(iii) a ball seat sub-assembly slidably disposed in the valve passageway between the piston valve and the lower end, the ball seat sub-assembly comprising a ball seat passageway extending therethrough, the ball seat sub-assembly further comprising a bypass port extending therethrough for allowing fluid circulation through the ball seat sub-assembly; and (iv) an inner piston sub-assembly releasably coupled to the piston valve and configured to disengage from the piston valve when pulled away from the ball seat, wherein the inner piston sub-assembly is releasably coupled to the ball seat sub-assembly, and the inner piston sub-assembly is configured to pull away from the ball seat sub-assembly to open the bypass port;

wherein the ball seat sub-assembly is configured to move the piston valve from the raised position to the lowered position when a downward force is applied to the ball seat sub-assembly;

(b) placing the apparatus in a tubing string disposed in the well, the apparatus located near a production zone in the formation;

(c) placing a ball configured to seal off the ball seat passageway when seated on the ball seat sub-assembly into the tubing string;

(d) injecting pressurized fracturing fluid into the tubing string wherein the fracturing fluid moves the ball through the tubing string into the apparatus until the ball is seated on the ball seat sub-assembly and places the downward force on the ball seat sub-assembly to move the piston valve from the closed position to the open position, wherein the fracturing fluid can pass through the at least one valve port of the apparatus to fracture the formation;

(e) providing a removal tool configured to separate the ball seat sub-assembly and the inner piston sub-assembly from the valve body;

(f) separating the ball seat sub-assembly and the inner piston sub-assembly from the valve body with the removal tool;

(g) providing a shifting tool; and (h) shifting the valve piston back to the raised position with the shifting tool.

14. A system for use downhole in a well, the system comprising:

(a) at least one apparatus, the apparatus comprising:

(i) a tubular valve body comprising an upper end and a lower end, and a valve passageway extending therethrough, the valve body further comprising at least one valve port extending through a sidewall thereof, the at least one valve port located nearer the upper end;

(ii) a tubular piston valve slidably disposed in the valve passageway and configured to provide communication therethrough, the piston valve configured to move from a raised position where the at least one valve port is closed to a lowered position where the at least one valve port is open;

(iii) a ball seat sub-assembly slidably disposed in the valve passageway between the piston valve and the lower end, the ball seat sub-assembly comprising a ball seat passageway extending therethrough, the ball seat sub-assembly further comprising a bypass port extending therethrough for allowing fluid circulation through the ball seat sub-assembly; and (iv) an inner piston sub-assembly releasably coupled to the piston valve and configured to disengage from the piston valve when pulled away from the ball seat, wherein the inner piston sub-assembly is releasably coupled to the ball seat sub-assembly, and the inner piston sub-assembly is configured to pull away from the ball seat sub-assembly to open the bypass port;

wherein the ball seat sub-assembly is configured to move the piston valve from the raised position to the lowered position when downward force is applied to the ball seat sub-assembly; and (b) at least one ball configured to seal off the ball seat passageway when seated on the ball seat sub-assembly, wherein the at least one ball is configured to specifically engage the ball seat sub-assembly of a particular apparatus and the at least one ball is targeted to the particular apparatus.

15. The system of claim 14 wherein the at least one apparatus further comprises means for holding the piston valve in the lowered position when it is moved from the raised position.

16. The system of claim 15 wherein the holding means comprises a ratchet ring disposed on the piston valve and corresponding ratchet threads disposed on an end-subassembly, wherein the end-subassembly is disposed at the lower end of the valve body.

17. The system of claim 15 wherein the holding means comprises fingers disposed on the piston valve and a corresponding groove disposed on an end-subassembly, wherein the end-subassembly is disposed at the lower end of the valve body.

18. The system of claim 14 further comprising a removal tool configured to separate the ball seat sub-assembly and the inner piston sub-assembly from the valve body.

19. The system of claim 18, wherein the removal tool comprises a tubular upper body comprising an upper removal tool end configured for coupling to coil tubing and a tubular lower body configured for coupling to the inner piston sub-assembly, the lower body coupled to the lower end of the upper body, wherein the upper body and lower body define a passageway extending through the removal tool.

* * * * *